US011780638B2

(12) United States Patent
Stout et al.

(10) Patent No.: US 11,780,638 B2
(45) Date of Patent: Oct. 10, 2023

(54) METHOD FOR INSTALLING A COVERING RELATIVE TO A FRAME OF AN ARCHITECTURAL STRUCTURE AND ASSOCIATED ALIGNMENT TOOLS

(71) Applicant: Levolor, Inc., Atlanta, GA (US)

(72) Inventors: Jeffrey Travis Stout, Sandy Springs, GA (US); John Michael Owen, Alpharetta, GA (US); Natalie Fay Bryan, Atlanta, GA (US)

(73) Assignee: LEVOLOR, INC., Atlanta, GA (US)

( * ) Notice: Subject to any disclaimer, the term of this patent is extended or adjusted under 35 U.S.C. 154(b) by 0 days.

(21) Appl. No.: 17/159,337

(22) Filed: Jan. 27, 2021

(65) Prior Publication Data

US 2021/0229855 A1 Jul. 29, 2021

Related U.S. Application Data

(60) Provisional application No. 62/966,783, filed on Jan. 28, 2020.

(51) Int. Cl.

| | |
|---|---|
| ***B65D 5/42*** | (2006.01) |
| ***B65D 5/54*** | (2006.01) |
| ***B65D 5/20*** | (2006.01) |
| ***B65D 5/66*** | (2006.01) |
| ***E06B 9/24*** | (2006.01) |

(52) U.S. Cl.

CPC ..... *B65D 5/4212* (2013.01); *B65D 5/2057* (2013.01); *B65D 5/545* (2013.01); *B65D 5/6655* (2013.01); *E06B 9/24* (2013.01)

(58) Field of Classification Search

CPC .... B65D 5/4212; B65D 5/2057; B65D 5/545; B65D 5/6655; B65D 5/4266; B65D 5/4204; B65D 5/22; E06B 9/24

USPC ..... 206/216

See application file for complete search history.

(56) References Cited

U.S. PATENT DOCUMENTS 3,203,613 A * 8/1965 Stowe ..... B65D 5/4608 229/117.17
3,281,035 A * 10/1966 Woodling ..... B65D 85/672 225/48
3,854,651 A * 12/1974 Osborne ..... B65D 5/4295 229/160

(Continued)

FOREIGN PATENT DOCUMENTS

GB 2320239 A * 6/1998 ..... B65D 5/3657

*Primary Examiner* — Steven A. Reynolds
*Assistant Examiner* — Prince Pal
(74) *Attorney, Agent, or Firm* — Dority & Manning, P.A.

(57) ABSTRACT

A method for installing a covering relative to a frame of an architectural structure includes unfolding a package defining a cavity configured to store the covering, with the package including an alignment tool. Furthermore, the method includes positioning the alignment tool relative to the frame such that a first panel of the tool is positioned adjacent to a vertically-extending surface of the frame and a second panel of the tool is positioned adjacent to horizontally-extending surface of the frame. Additionally, the method includes forming mounting holes in one of the vertically-extending surface at first mounting hole locations identified by apertures defined by the first panel or the horizontally-extending surface of the frame at second mounting hole locations identified by apertures defined by the second panel.

12 Claims, 13 Drawing Sheets

(56) References Cited

U.S. PATENT DOCUMENTS

| | | | | | |
|---|---|---|---|---|---|
| 3,949,931 | A * | 4/1976 | Hall | B65D 5/4295 | 229/160 |
| 4,405,066 | A * | 9/1983 | Roccaforte | B65H 35/0006 | 225/48 |
| 5,476,218 | A * | 12/1995 | Reisman | B65D 5/18 | 229/164 |
| 5,511,663 | A * | 4/1996 | Shimura | B65D 83/0841 | 206/408 |
| 2013/0334096 | A1* | 12/2013 | Fath | B65D 5/16 | 206/774 |
| 2019/0112095 | A1* | 4/2019 | Swarnaraj | B65D 5/3621 | |
| 2021/0114797 | A1* | 4/2021 | Padilla | B65D 5/5019 | |

* cited by examiner

METHOD FOR INSTALLING A COVERING RELATIVE TO A FRAME OF AN ARCHITECTURAL STRUCTURE AND ASSOCIATED ALIGNMENT TOOLS

CROSS-REFERENCE TO RELATED APPLICATIONS

This application is based upon and claims the right of priority to U.S. Provisional Patent Application No. 62/966,783, filed on Jan. 28, 2020, the disclosure of which is hereby incorporated by reference herein in its entirety for all purposes.

FIELD

The present disclosure generally relates to methods for installing a covering relative to a frame of an architectural structure and, more particularly, to methods for installing a covering relative to a frame of an architectural structure using an alignment tool.

BACKGROUND

Various coverings, such as blinds and/or shades, may be installed relative to a frame of an architectural structure (e.g., a window or door) to provide privacy, block sunlight, and/or improve the aesthetic appearance. Typically, such coverings are supported relative to the frame using a plurality of mounting devices (e.g., brackets) coupled to the window frame via fasteners. To properly position a covering relative to a frame, the mounting holes for the fasteners must be positioned at specific locations on the frame. However, in certain instances, it may be difficult to properly determine such mounting hole locations. When the mounting holes are incorrectly positioned, the covering may be misaligned (e.g., not centered and/or level) relative to the architectural structure, thereby resulting in an undesirable aesthetic appearance.

Accordingly, an improved method for installing a covering relative to a frame of an architectural structure and an associated alignment tool would be welcomed in the technology.

BRIEF DESCRIPTION

Aspects and advantages of the present disclosure will be set forth in part in the following description, or may be obvious from the description, or may be learned through practice of the present disclosure.

In one aspect, the present subject matter is directed to a method for installing a covering relative to a frame of an architectural structure. The method includes unfolding a package defining a cavity configured to store the covering. The package, in turn, includes an alignment tool having a first panel defining a plurality of apertures and a second panel defining a plurality of apertures, with the first panel joined to the second panel at a fold line. Furthermore, the method includes positioning the alignment tool relative to the frame such that the first panel is positioned adjacent to and extends along a vertically-extending surface of the frame and the second panel is positioned adjacent to and extends along a horizontally-extending surface of the frame. The plurality of apertures defined by the first panel identifies first mounting hole locations for the covering on the vertically-extending surface and the plurality of apertures defined by the second panel identifies second mounting hole locations for the covering on the horizontally-extending surface. Additionally, the method includes forming mounting holes in one of the vertically-extending surface at the first mounting hole locations or the horizontally-extending surface of the frame at the second mounting hole locations.

In another aspect, the present subject matter is directed to a package for storing a covering for an architectural structure. The package includes a plurality of walls at least partially defining a cavity configured to receive the covering. The plurality of walls, in turn, includes a bottom wall and first and second laterally-extending walls oriented perpendicular relative to and joined to the bottom wall. First and second panels of an alignment tool are formed by at least one wall of the plurality of walls. The first panel defines a plurality of apertures identifying first mounting hole locations for installing the covering on a vertically-extending surface of a frame of the architectural structure. Moreover, the second panel defines a plurality of apertures identifying second mounting hole locations for installing the covering on a horizontally-extending surface of the frame.

In a further aspect, the present subject matter is directed to an alignment tool for installing a covering relative to a frame of an architectural structure. The alignment tool includes a first panel configured for placement adjacent to a vertically-extending surface of the frame. In this respect, the first panel defines a plurality of apertures identifying first mounting hole locations for installing the covering on the vertically-extending surface. Furthermore, alignment tool includes the second panel configured for placement adjacent to a horizontally-extending surface of the frame. As such, the second panel defines a plurality of apertures identifying second mounting hole locations for installing the covering on the horizontally-extending surface. Moreover, the first panel is joined to the second panel at a fold line such that the first panel and the second panel are pivotable between an unfolded configuration in which the first panel and the second panel are coplanar and an installation configuration in which the first panel and the second panel are substantially perpendicular.

These and other features, aspects and advantages of the present disclosure will become better understood with reference to the following Detailed Description and appended claims. The accompanying drawings, which are incorporated in and constitute a part of this specification, illustrate embodiments of the present disclosure and, together with the description, serve to explain the principles of the present disclosure.

This Brief Description is provided to introduce a selection of concepts in a simplified form that are further described below in the Detailed Description. This Brief Description is not intended to identify key features or essential features of the claimed subject matter, nor is it intended as an aid in determining the scope of the claimed subject matter.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

Figure 1:
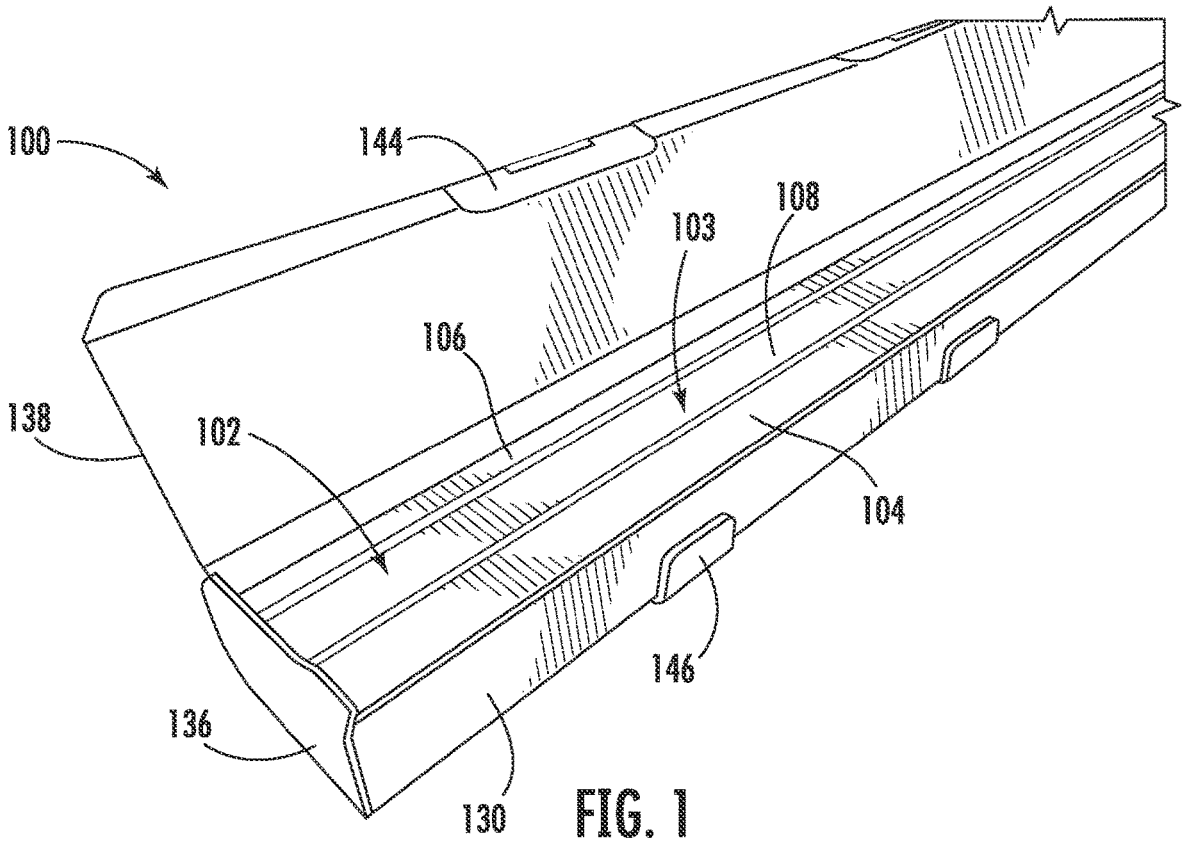
FIG. 1 illustrates a perspective view of one embodiment of a package for storing a covering for an architectural structure in accordance with aspects of the present subject matter, particularly illustrating the covering positioned within a cavity defined by the package.

Repeat use of reference characters in the present specification and drawings is intended to represent the same or analogous features or elements of the present technology.

DETAILED DESCRIPTION

In general, the present subject matter is directed to methods for installing a covering, such as a blind or a shade, relative to a frame of an architectural structure, such as a window or a door. More specifically, as part of the disclosed method, an alignment tool is used to identify mounting hole locations for the covering on the frame. As will be described below, the alignment tool permits installation of the covering on a vertically-extending surface of the frame (e.g., the vertically-extending surface defined by the upper or top frame member that faces outwardly towards the room) or on a horizontally-extending surface of the frame (e.g., the horizontally-extending surface defined by the top frame member of the frame that extends perpendicular to the vertically-extending surface of such frame member and faces towards the bottom of the frame). Mounting along such vertically-extending surface is generally referred to as outside mounting since the covering is mounted along an outside or exterior-facing surface of the frame, while mounting along such horizontally-extending surface is generally referred to as inside mounting since the covering is mounted within the interior of the frame.

In several embodiments, the alignment tool includes first and second panels. More specifically, in one embodiment, the first panel is configured for placement adjacent to the vertically-extending surface of the frame. In this respect, the first panel defines a plurality of apertures identifying first mounting hole locations for installing the covering on the vertically-extending surface. Furthermore, in one embodiment, the second panel is configured for placement adjacent to the horizontally-extending surface of the frame. As such, the second panel defines a plurality of apertures identifying second mounting hole locations for installing the covering on the horizontally-extending surface. Additionally, in one embodiment, the first and second panels are joined together at a fold line (e.g., a crease). Thus, the first and second panels may be pivoted between an unfolded configuration and an installation configuration in which the first and second panels are substantially perpendicular.

In some embodiments, the alignment tool is formed from a portion of the package in which the covering is stored/transported. In general, the package includes various walls defining a cavity configured to receive the covering. For example, in one embodiment, the package includes a bottom wall and first and second laterally-extending walls oriented perpendicular relative to the bottom wall. In one embodiment, the bottom wall forms one of the first panel or the second panel of the alignment tool and the first or second laterally-extending wall forms the other panel of the alignment tool. In such an embodiment, a perforated line may, for example, be defined between the bottom wall and the other laterally-extending wall to permit separation of the alignment tool from the remaining portion of the package.

As mentioned above, the disclosed methods include the use of one or more embodiments of the alignment tool. Specifically, in several embodiments, the methods include unfolding the package in which the covering is stored/transported and separating the alignment tool from the remaining portion(s) of the package. Moreover, the method includes positioning the alignment tool adjacent to the frame of the architectural structure such that the first panel extends along a vertically-extending surface of the frame and the second panel extends along a horizontally-extending surface of the frame. Thereafter, the method includes forming mounting holes in the frame based on the locations of the apertures defined by the alignment tool. For example, when outside mounting is desired, mounting holes may be formed in the vertically-extending surface at first mounting hole locations identified by the apertures defined by the first panel. Conversely, mounting holes may be formed in the horizontally-extending surface at second mounting hole locations identified by the apertures defined by the second panel when inside mounting is desired. By identifying mounting hole locations for the covering when positioned adjacent to the frame of the architectural structure, the disclosed alignment tool improves the accuracy of the formed mounting holes and reduces the amount of time necessary to install the covering relative to the frame.

Figure 2:
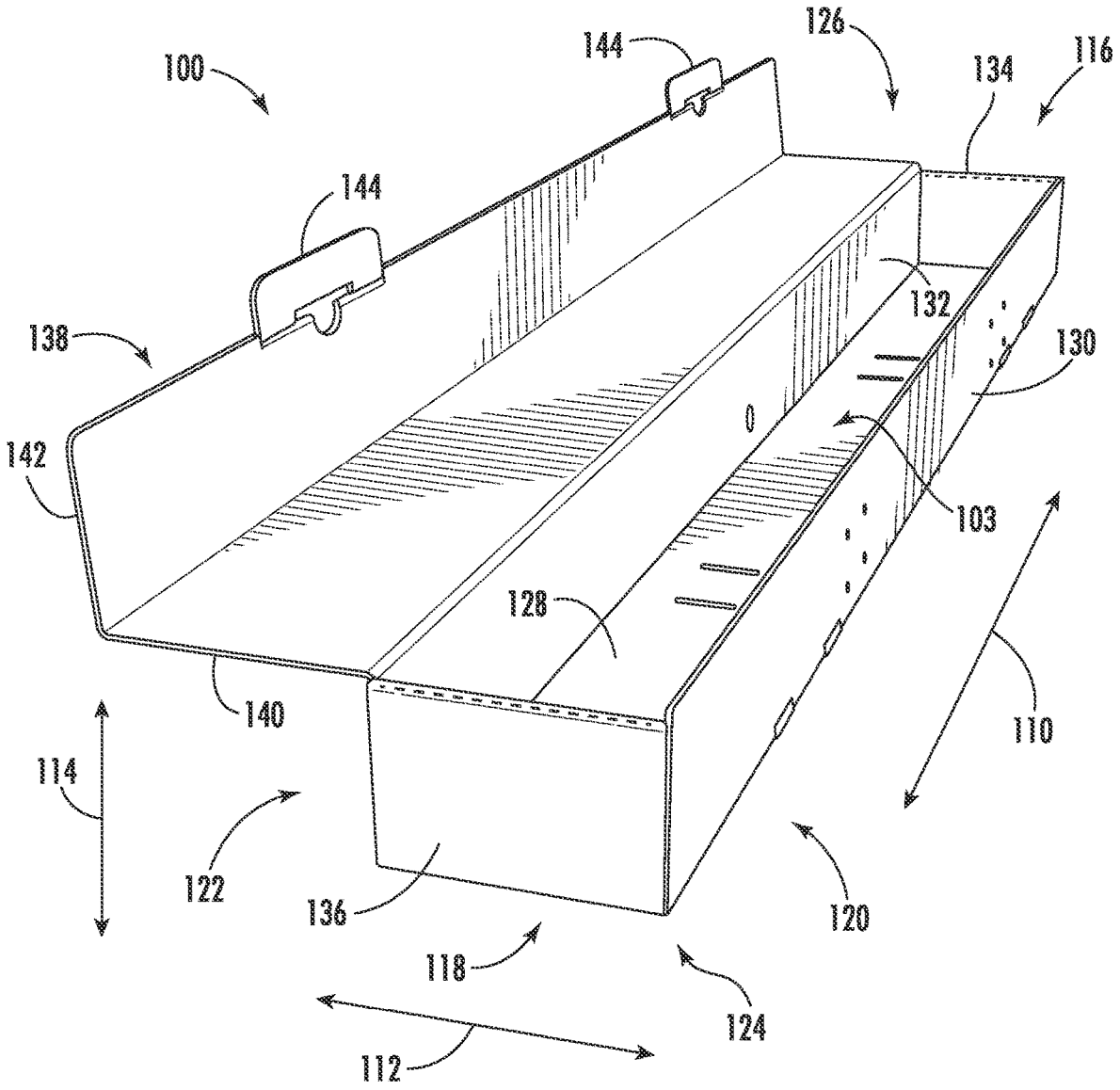
FIG. 2 illustrates another perspective view of the package shown in FIG. 1, particularly illustrating the package in a folded configuration with the covering removed from the cavity.
Figure 3:
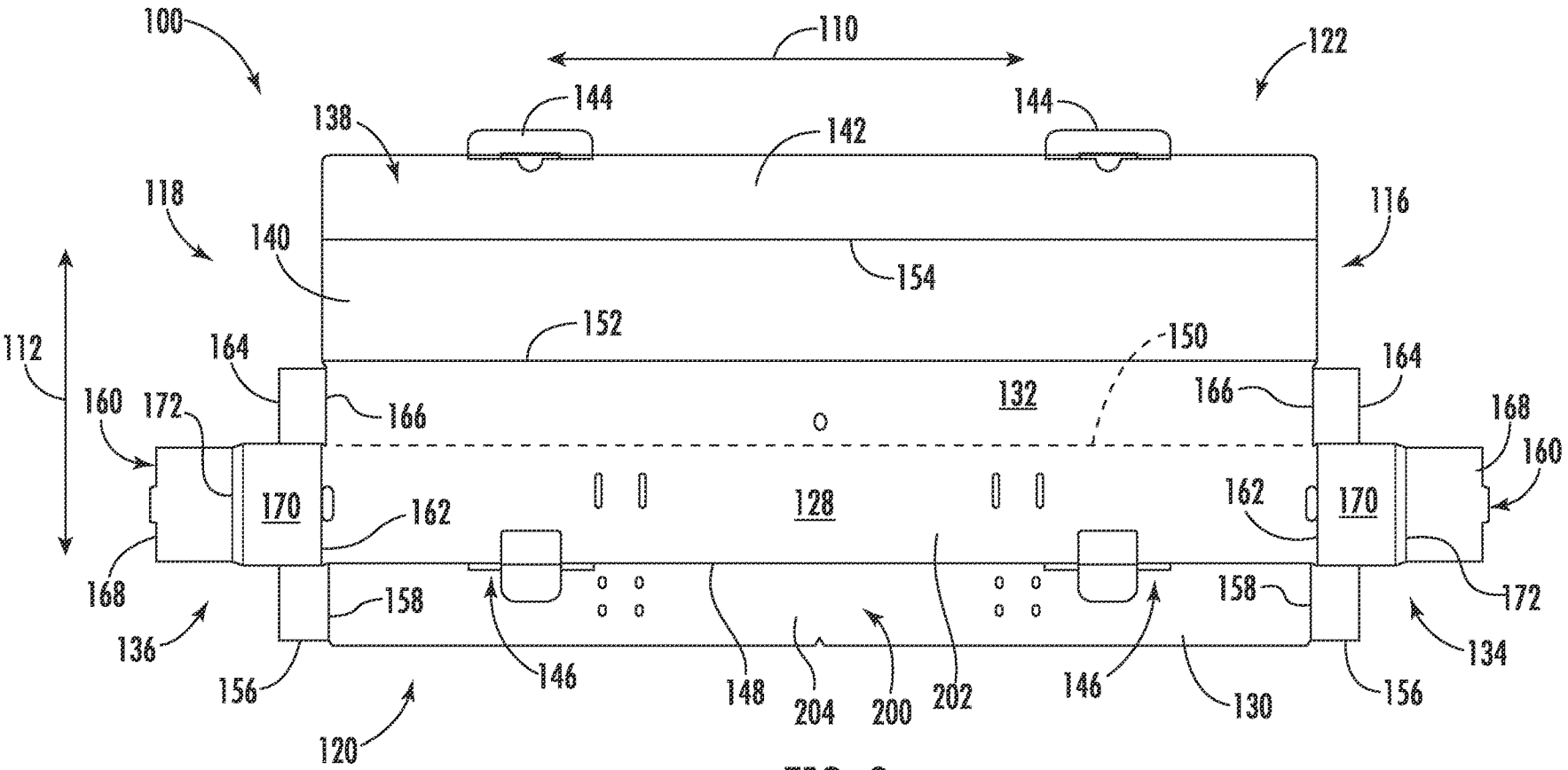
FIG. 3 illustrates a top view of the package shown in FIGS. 1 and 2, particularly illustrating the package in an unfolded configuration, with a bottom wall and a first laterally-extending wall of the package forming an alignment tool.

Referring now to the drawings, FIGS. 1-3 illustrate different views of a package 100 for storing and/or transporting a covering 102 configured for installation relative to a frame of an architectural structure, such as a window or door. Specifically, FIG. 1 illustrates a perspective view of the package 100 in a folded configuration with the covering 102 positioned within the package 100. Moreover, FIG. 2 illustrates another perspective view of the package 100 in the folded configuration with the covering 102 removed from the package 100. Additionally, FIG. 3 illustrates a top view of the package 100 in an unfolded configuration.

In general, the package 100 may be configured to store the covering 102 during transportation and handling of the covering 102. As such, the package 100 may define a cavity 103 configured to store the covering 102 when the package 100 is in the folded configuration shown in FIGS. 1 and 2. It should be appreciated that the package 100 may be configured to store any suitable covering for a window, door, or other architectural structure, such as a venetian blind, a roman shade, a cellular shade, a vertical blind, and/or the like. For example, in the illustrated embodiment, the covering 102 includes a headrail 104, a bottom rail 106, and at least one covering element 108 extending between the headrail 104 and the bottom rail 106. However, in alternative embodiments, the covering 102 may have any other suitable configuration.

Referring particularly to FIG. 2, the package 100 may define a lateral direction 110, a transverse direction 112, and a vertical direction 114. More specifically, the lateral direction 110 may extend between a first lateral side 116 of the package 100 and a second lateral side 118 of the package 100. Furthermore, the transverse direction 112 may extend perpendicular to the lateral direction 110 and between a first transverse side 120 of the package 100 and a second transverse side 122 of the package 100. In addition, the vertical direction 114 may extend perpendicular to the lateral and transverse directions 110, 112 and between a bottom end 124 of the package 100 and a top end 126 of the package 100.

In several embodiments, the package 100 may include a plurality of walls. Specifically, the package 100 may include a bottom wall 128 defining the bottom end 124 of the package 100 and extending in the lateral and transverse directions 110, 112. Additionally, the package 100 may include first and second laterally-extending walls 130, 132 extending upward (toward the top end 126) from the bottom wall 128 such that the laterally-extending walls 130, 132 are substantially perpendicular to the bottom wall 128. As used herein, "substantially perpendicular" walls or panels are oriented at between an eighty-degree angle and a one hundred-degree angle relative to each other. Moreover, the first and second laterally-extending walls 130, 132 may also extend in the lateral direction 110 and be spaced apart from each other in the transverse direction 112. Furthermore, the package 100 may include first and second transversely-extending walls 134, 136 extending upward (toward the top end 126) from the bottom wall 128 such that the first and second transversely-extending walls 134, 136 are substantially perpendicular to the bottom wall 128 and the first and second laterally-extending walls 130, 132. As shown, the first and second transversely-extending walls 134, 136 may also extend in the transverse direction 112 and be spaced apart from each other in the lateral direction 110. In this respect, the first and second transversely-extending walls 132, 136 may extend between the first and second laterally-extending walls 103, 132. Additionally, as will be described below, the package 100 may also include a lid 138.

As shown, the various walls 128, 130, 132, 134, 136, 138 of the package 100 may generally define the cavity 103 of the package 100. As such, in several embodiments, the cavity 103 may be defined in the lateral direction 110 between the first and second laterally-extending walls 130, 132, in the transverse direction 112 between the first and second transversely-extending walls 134, 136, and in the vertical direction 114 between the bottom wall 128 and the lid 138. However, in alternative embodiments, the package 100 may have any other suitable configuration or arrangement of walls defining a cavity configured for the reception of the covering 102.

In some embodiments, the lid 138 may be positioned proximate to the top end 126 of the package 100 such that the lid 138 is configured to selectively provide access to the cavity 103. Specifically, when in an opened position (shown in FIG. 2), the lid 138 may permit access to the cavity 103 to allow the covering 102 to be removed from the package 100. Conversely, the lid 138 may prevent access to the cavity 103 when in a closed position. In one embodiment, as shown, the lid 138 may include a first lid portion 140 and a second lid portion 142. Additionally, in some embodiments, the lid 138 may include a pair of first closure members 144 configured to engage corresponding pair of slots 146 (FIG. 3) to secure the lid 138 in the closed position. However, in alternative embodiments, the lid 138 may have any other suitable configuration.

Referring now to FIG. 3, in several embodiments, the package 100 may be formed from a single sheet of material. As such, the various walls 128, 130, 132, 134, 136, 138 of the package 100 may be joined at various fold lines. For example, the first and second laterally-extending walls 130, 132 may be joined at fold lines 148, 150, respectively. Furthermore, the lid 138 may be joined to the second laterally-extending wall 132 at a fold line 152, with the first and second lid portions 140, 142 joined together at a fold line 154. Additionally, in some embodiments, the first and second transversely-extending walls 134, 136 may be formed from several wall portions. For example, in one embodiment, the first and second transversely-extending walls 134, 136 may each include a first wall portion 156 joined to the first transversely-extending wall 130 at a fold line 158, a second wall portion 160 joined to the bottom wall 128 at a fold line 162, and a third wall portion 164 joined to the second transversely-extending wall 130 at a fold line 166. Each second wall portion 160 may, in turn, include a first section 168 joined to a second section 170 at a fold line 172. As such, when the package 100 is in the folded configuration, the first and third wall portions 156, 164 may be positioned between the first and second sections 168, 170 of the corresponding second wall portions 160 to form the transversely-extending walls 134, 136. In this respect, the sheet of material may be folded at the various fold lines 148, 150, 152, 154, 158, 162, 164, 172 to convert the package 100 from the unfolded configuration shown in FIG. 3 to the folded configuration shown in FIGS. 1 and 2. However, in alternative embodiments, the package 100 may be formed from any suitable number of sheets of material, such as a plurality of sheets of material.

It should be appreciated that the fold lines may correspond to any suitable joints that joins or otherwise couples two or more walls (or portions of such walls) of the package 100 together. For example, in several embodiments, the fold lines may correspond to creases and/or perforations. Specifically, a crease may correspond to a region of material disposed between a pair of walls that is thinner than such walls to allow relative pivoting therebetween. As such, a crease may allow a pair of adjacent walls to pivot relative to, but not separate (without cutting) from, each other. Moreover, a perforation may be a line or row of spaced apart apertures or slits disposed between a pair of walls that permit such walls to pivot relative to each other. The apertures/slits may, in turn, allow the pair of walls to be separated by a consumer without the use of tools (e.g., a knife or scissors). In another embodiment, one or more of the fold lines may correspond to a bonded joint(s) at which two or more of the walls of the package 100 bonded together via a suitable adhesive. Moreover, in a further embodiment, one or more of the fold lines may correspond to a taped joint(s) at which two or more of the walls of the package 100 coupled together via a suitable adhesive tape. However, in alternative embodiments, the walls 128, 130, 132, 134, 136, 138 of the package 100 may be joined together at the various fold lines 148, 150, 152, 154, 158, 162, 164, 172 in any other suitable manner.

Additionally, in several embodiments, the package 100 may be configured such that the covering 102 may be cut to length while the covering 102 is present within the cavity 103 of the package 100. In general, the covering 102 may be manufactured in several predetermined lateral lengths. However, the lateral lengths of certain architectural structures may not correspond to one of the predetermined lateral lengths of the covering 102. Therefore, it may be necessary to cut the covering 102 to a lateral length corresponding to the specific architectural structure relative to which the covering 102 is to be installed. In such instances, the package 100 and the covering 102 positioned within the cavity 102 of the package 100 may be cut to the desired lateral length. Such cutting of the package/covering 100/102 may result in the bottom wall 128, the first and second laterally-extending walls 130, 132, and the lid 128 having the same lateral width as the covering 102. Moreover, such cutting may remove the first and second transversely-extending walls 134, 136 from the package 100. As such, end caps (not shown) may be coupled to the lateral ends of the package 100 to close the lateral ends of the package 100 and retain the structural rigidity thereof.

It should be appreciated that the package 100 may be formed from any suitable material that provides sufficient rigidity to permit transportation and handling of the covering 102 without damage thereto. For example, in several embodiments, the package 100 may be formed from a heavy-duty paper-based material, such as paperboard or corrugated fiberboard/cardboard. However, in alternative embodiments, the package may be formed from any other suitable material, such as a plastic or polymer-based material.

Furthermore, it should be further appreciated that the configuration of the package 100 described above and shown in FIGS. 1-3 is provided only to place the present subject matter in an exemplary field of use. Thus, it should be appreciated that the present subject matter may be readily adaptable to any manner of package configuration.

In accordance with aspects of the present subject matter, at least a portion of the package 100 may form an alignment tool 200 for use in installing the covering 102 relative to a frame of an architectural structure, such as a window or a door. As will be described below, the alignment tool 200 may, in turn, be used to determine the locations of mounting holes for the covering 102 on the frame of the architectural structure. As such, in several embodiments, one or more walls of the package may form the alignment tool 200. For example, as shown in FIG. 3, in one embodiment, the bottom wall 128 and the first laterally-extending wall 130 form the alignment tool 200. Specifically, the bottom wall 128 may form a first panel 202 of the alignment tool 200 and the first laterally-extending wall 130 may form a second panel 200 of the alignment tool 200. In such an embodiment, the fold line 150 may correspond to a perforation. As such, the portion of the package 100 corresponding to the alignment tool 200, namely the bottom wall 128 and the first laterally-extending wall 130, may be separated from the remaining portion(s) of the package 100 via the perforation at the fold line 150. In certain instances (e.g., when the covering 102 is not cut to length in the package 100), the first and second wall portions 156, 160 of the first and second transversely-extending walls 134, 136 may remain attached to the first and second panels (the bottom wall 128 and the first laterally-extending wall 130) of the alignment tool 200 after the alignment tool 200 is separated from the remaining portion(s) of the package 100. As will be described below, in such instances, the first and second wall portions 156, 160 of the first and second transversely-extending walls 134, 136 may be removed from the first and second panels (e.g., via cutting) before use of the alignment tool 200.

Figure 4:
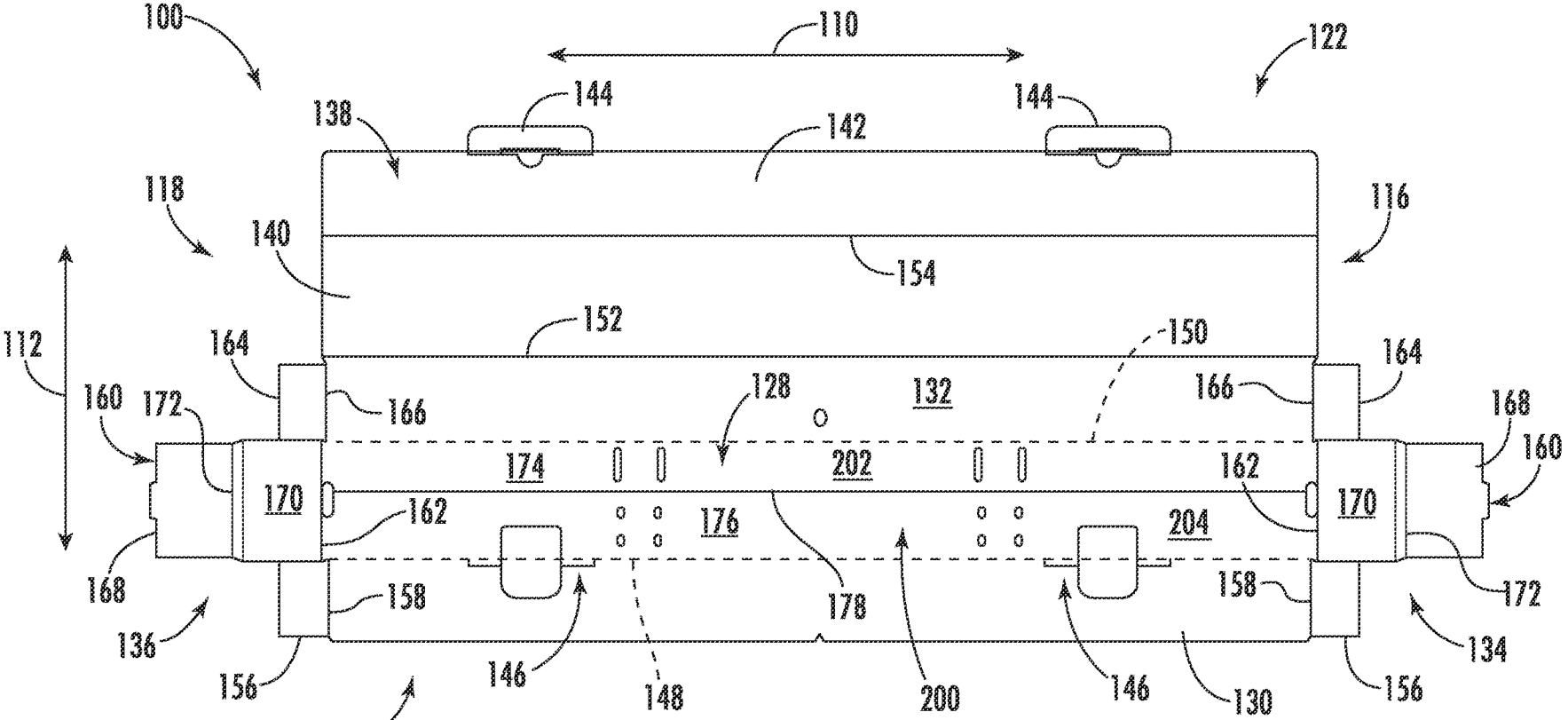
FIG. 4 illustrates a top view of another embodiment of the package shown in FIGS. 1-3 in the unfolded configuration, particularly illustrating the bottom wall forming the alignment tool.

As shown in FIG. 4, in another embodiment, the bottom wall 128 entirely forms the alignment tool 200. Specifically, a first portion 174 of the bottom wall 128 may form the first panel 202 of the alignment tool 200 and a second portion 176 of the bottom wall 128 may form the second panel 200 of the alignment tool 200. Moreover, a crease 178 may join the first and second portions 174, 176 of the bottom wall 128. In such an embodiment, the fold lines 148, 150 may correspond to perforations. As such, the portion of the package 100 corresponding to the alignment tool 200, namely the bottom wall 128, may be separated from the remaining portions of the package 100 via the perforations at the fold lines 148, 150. In certain instances (e.g., when the covering 102 is not cut to length in the package 100), the second wall portions 160 of the first and second transversely-extending walls 134, 136 may remain attached to the first and second panels (the bottom wall 128) of the alignment tool 200 after the alignment tool 200 is separated from the remaining portion(s) of the package 100. As will be described below, in such instances, the second wall portions 160 of the first and second transversely-extending walls 134, 136 may be removed from the first and second panels before use of the alignment tool 200.

Figure 5:
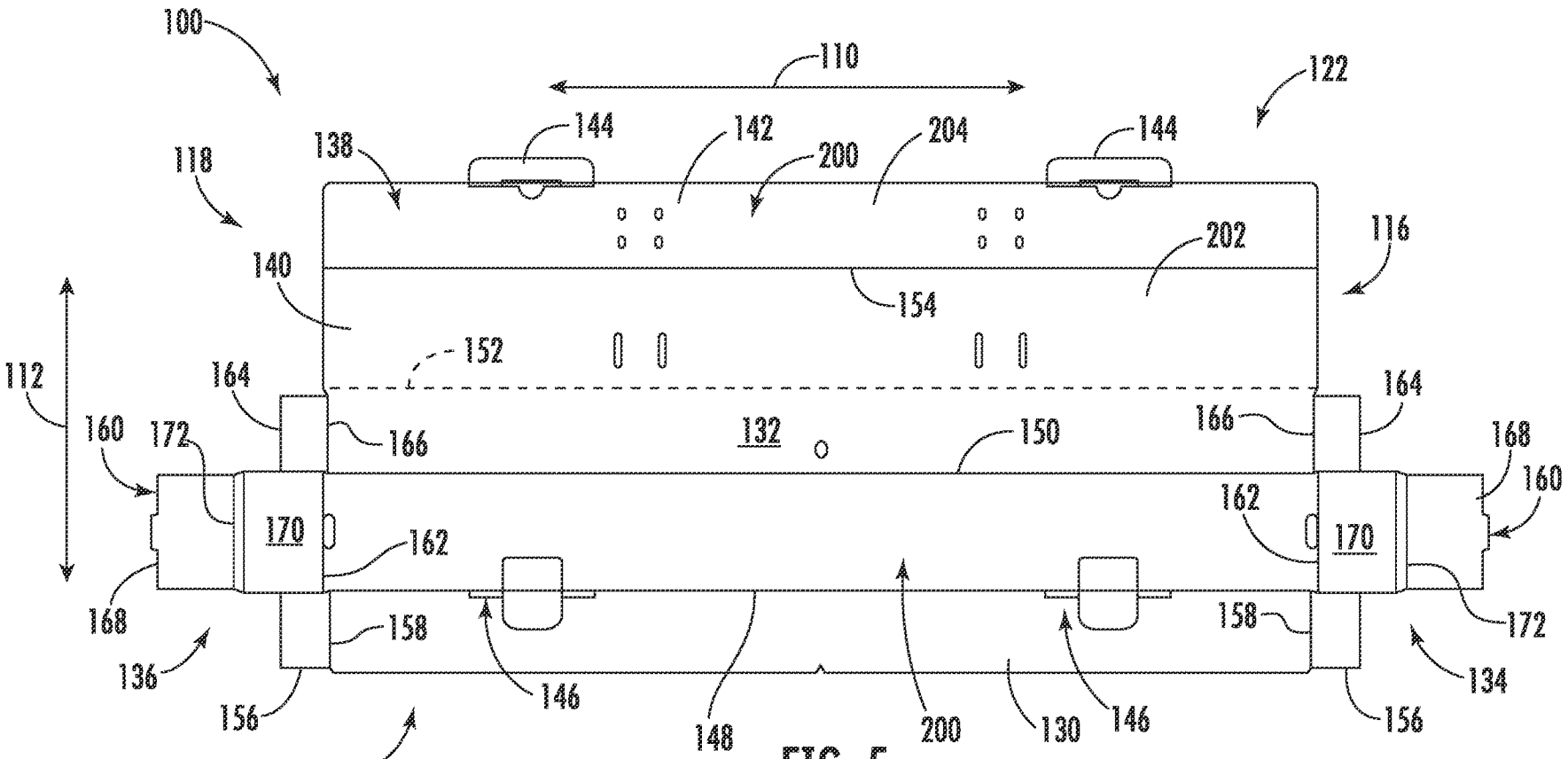
FIG. 5 illustrates a top view of a further embodiment of the package shown in FIGS. 1-3 in the unfolded configuration, particularly illustrating a lid of the package forming the alignment tool.

Moreover, as shown in FIG. 5, in a further embodiment, the lid 138 forms the alignment tool 200. Specifically, the first lid portion 140 may form the first panel 202 of the alignment tool 200 and the second lid portion 142 of the bottom wall 128 may form the second panel 200 of the alignment tool 200. In such an embodiment, the fold line 152 may correspond to a perforation. As such, the portion of the package 100 corresponding to the alignment tool 200, namely the lid 138, may be separated from the remaining portion of the package 100 via the perforation at the fold line 152. However, in alternative embodiments, any other wall(s) of the package 100 may be used to form the alignment tool 200. As will be described below, in some embodiments, the alignment tool 200 may be separated from the remaining portion of the package 100 by cutting along the fold line (e.g., a crease at the fold line) separating the alignment tool 200 from the remaining portion of the package 100. Alternatively, in one embodiment, the alignment tool 200 may not be separated from the remaining portion of the package 100 before use in installing the covering 102.

It should be appreciated that forming the alignment tool 200 from a portion of the package 100 provides several advantages. For example, with such a configuration, it is not necessary to form the alignment tool 200 from additional material that is separate from the material used to form the package 100, thereby reducing the amount of material used to package/store the covering 102. Moreover, it is not necessary to place the alignment tool 200 in the cavity 103 of the package 100 with the covering 102 since the alignment tool 200 is already part of the package 100, thereby reducing the likelihood that the package/covering 100/102 is provided to the consumer without an alignment tool.

Figure 6:
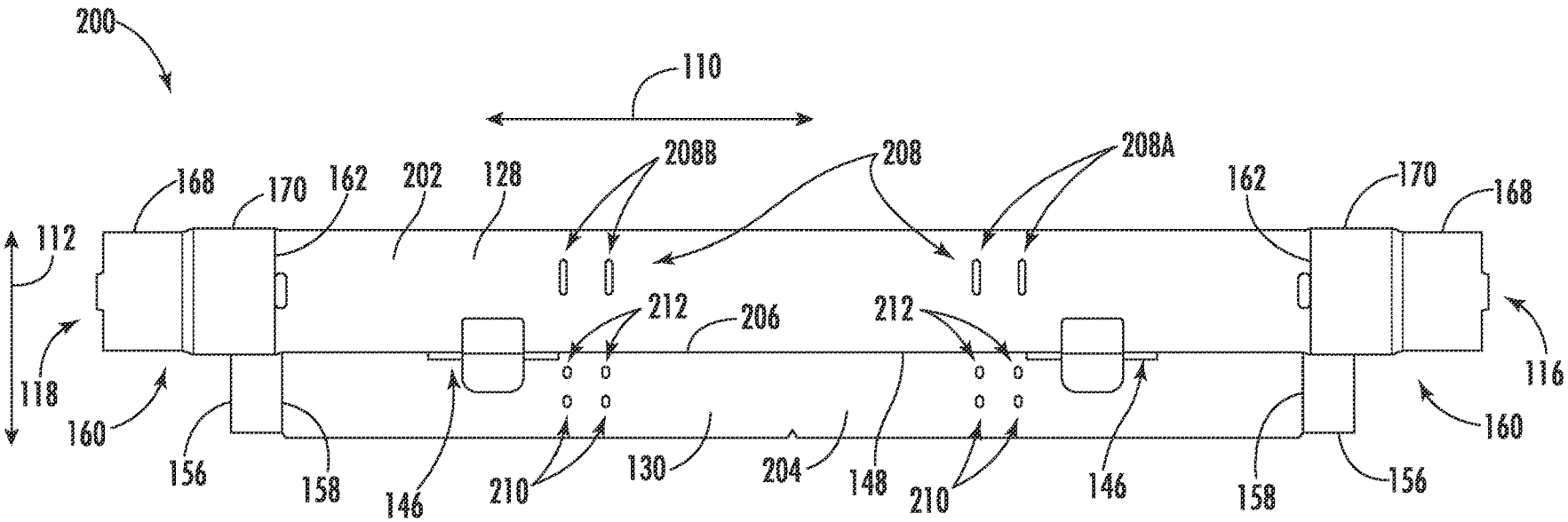
FIG. 6 illustrates a top view of one embodiment of an alignment tool for use in installing a covering relative to a frame of an architectural structure in accordance with aspects of the present subject matter, particularly illustrating the alignment tool in an unfolded configuration.
Figure 7:
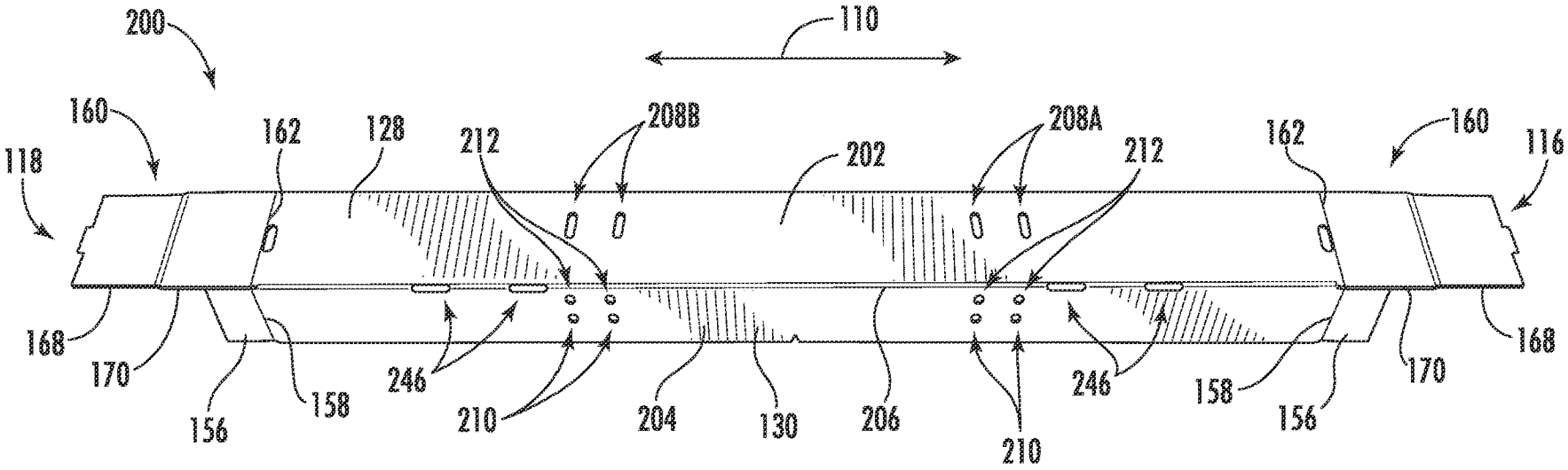
FIG. 7 illustrates a perspective view of the alignment tool shown in FIG. 6, particularly illustrating the alignment tool in an installation configuration.

Referring now to FIGS. 6 and 7, different views of one embodiment of an alignment tool 200 for use during installation of a covering relative to a frame of an architectural structure is illustrated in accordance with aspects of the present subject matter. Specifically, FIG. 6 illustrates a top view of the alignment tool 200 in an unfolded configuration. Additionally, FIG. 7 illustrated a perspective view of the alignment tool 200 in an installation configuration.

In several embodiments, a first panel 202 of the alignment tool 200 may be joined to the second panel 204 of the alignment tool 200 at a fold line 206. In such embodiments, the fold line 206 may permit the first panel 202 to pivot relative to the second panel 204. As such, the first and second panels 202, 204 may be pivotable between the unfolded configuration in which the first and second panels 202, 204 are generally coplanar and the installation configuration in which the first and second panels 202, 204 are substantially perpendicular. In the embodiment illustrated in FIG. 6, the first and second panels 202 are formed from the bottom wall 128 and the first laterally-extending wall 130, respectively, of the package 100 described above with reference to FIGS. 1-3. In such an embodiment, the fold line 206 of the alignment tool 200 may correspond to the fold line 148 of the package 100. However, in alternative embodiments, the alignment tool 200 may be formed from any other suitable wall(s) of the package 100. Moreover, in further embodiments, the alignment tool 200 may be formed separately from the package 100.

In accordance with aspects of the present subject, the alignment tool 200 may identify mounting hole locations for installing the packaged covering 102 (e.g., a blind or a shade) relative to an architectural structure, such as a window or a door. Specifically, in several embodiments, the alignment tool 200 may identify mounting locations for mounting the covering 102 on a vertically-extending surface 236 (FIG. 10) of a frame 214 (FIG. 10) of the architectural structure to permit outside mounting of the covering 102. Moreover, in such embodiments, the alignment tool 200 may also identify mounting locations for mounting such covering 102 on an adjacent horizontally-extending surface 238 (FIG. 10) of the frame 214 to permit inside mounting of the covering 102. As such, the alignment tool 200 may permit installation of the covering 102 relative to multiple surfaces of the frame of the architectural structure using a single tool.

In several embodiments, the first panel 202 of the alignment tool 200 may identify the mounting hole locations for the vertically-extending surface 236 of the frame 214. More specifically, the first panel 202 may be configured for placement adjacent to the vertically-extending surface 236 of the frame 214 such that the first panel 202 extends along the vertically-extending surface 236. In this respect, the first panel 202 may define a plurality of apertures 208 that identify the mounting hole locations on the vertically-extending surface 236. Thus, the apertures 208 may be positioned along the first panel 202 such that, when the first panel 202 is placed adjacent to the vertically-extending surface 236, the apertures 208 are positioned at locations relative to the vertically-extending surface 236 that are suitable for forming mounting holes for installing the covering 102. It should be appreciated that, although the mounting apertures 208 are shown in FIG. 6 as being offset or otherwise spaced apart from the slots 146 that receive the closure members 144 along the lateral direction 110, the mounting apertures 208 may, in other embodiments, be aligned with the slots 146 along the lateral direction 110.

The apertures 208 may generally be spaced apart from each other along the lateral direction 110 to identify mounting locations for a plurality of brackets (not shown) for coupling the covering 102 relative to the frame 214. For example, as shown in FIG. 6, in one embodiment, a first pair of the apertures 208A is defined by the first panel 202 such that the apertures 208 identify mounting hole locations for a first bracket (not shown) used to couple a first side of the covering 102 to a first side of the frame 214. Furthermore, as shown in FIG. 6, in such an embodiment, a second pair of the apertures 208 is defined by the first panel 202 such that the apertures 208 identify mounting hole locations for a second bracket (not shown) used to couple an opposed, second side of the covering 102 to an opposed, second side of the frame 214. In this respect, the lateral spacing between the first and second pairs of apertures 208 may generally correspond to the desired lateral spacing of the brackets. Moreover, the lateral spacing between the respective apertures of each pair of apertures 208A, 208B may correspond to the lateral spacing of the mounting holes of the corresponding bracket. However, in alternative embodiments, the first panel 202 may define any other suitable number of apertures and/or the apertures may be positioned at any other suitable positions on the on the first panel 202. For example, in one embodiment, the first panel 202 may define three pairs of laterally-spaced apart apertures 208 to permit installation of three mounting brackets.

In one embodiment, the mounting apertures 208 may be elongated slots. In such an embodiment, when the alignment tool is in the unfolded configuration, the diameter of the mounting apertures 208 may be greater in the transverse direction 112 than in the lateral direction 110. As such, the mounting apertures 208 may allow adjustment of the vertical positioning of the covering 102 relative to the vertically-extending surface 236 of the frame 214, while maintaining the desired laterally spacing of the mounting holes. However, in alternative embodiments, the mounting apertures 208 may have any other suitable shape, such as a circular shape. In a further embodiment, the apertures 208 may be elongated slots or notches that extend to an outer edge of the first panel 202.

Additionally, the second panel 204 of the alignment tool 200 may identify the mounting hole locations for the horizontally-extending surface 238 of the frame 214. More specifically, the second panel 204 may be configured for placement adjacent to the horizontally-extending surface 238 of the frame 214 such that the first panel 202 extends along the vertically-extending surface 236. In this respect, the second panel 204 may define a plurality of apertures (e.g., apertures 210 and apertures 212) that identify the mounting hole locations on the horizontally-extending surface 238. Thus, the apertures may be positioned on the second panel 204 such that, when the second panel 204 is placed adjacent to the horizontally-extending surface 238, the apertures are positioned at locations relative to the horizontally-extending surface 238 that are suitable for forming mounting holes for installing the covering 102. Moreover, as shown, in one embodiment, the apertures defined by the second panel 204 may be circular apertures. However, in alternative embodiments, the apertures defined by the second panel 204 may have any other suitable shape, such as an elongated shape. In a further embodiment, the apertures defined by the second panel 204 may be elongated slots or notches that extend to an outer edge of the second panel 204.

In several embodiments, as shown in FIGS. 6 and 7, the apertures defined by the second panel 204 may include a first set of apertures 210 and a second set of apertures 212. More specifically, when the alignment tool 200 is in the unfolded configuration, the apertures 210 may be spaced apart from the apertures 212 in the transverse direction 112. Moreover, the apertures 212 are positioned closer to the fold line 206 than the apertures 210. In this respect, when the second panel 204 is positioned adjacent to the horizontally-extending surface 238 of the frame 214, the apertures 210 may identify mounting hole locations associated with flushing mounting the covering 102 relative to the frame 214. The covering 102 may be flush-mounted when the outer surface of the headrail 104 of the covering 102 (i.e., the surface of the headrail 104 distal to the architectural structure) is flush or otherwise co-planar with the vertically-extending surface 236 of the frame 214. In this respect, the apertures 210 may be defined at a transverse position on the second panel 204 that permits flushing mounting of the covering 102.

Figure 8:
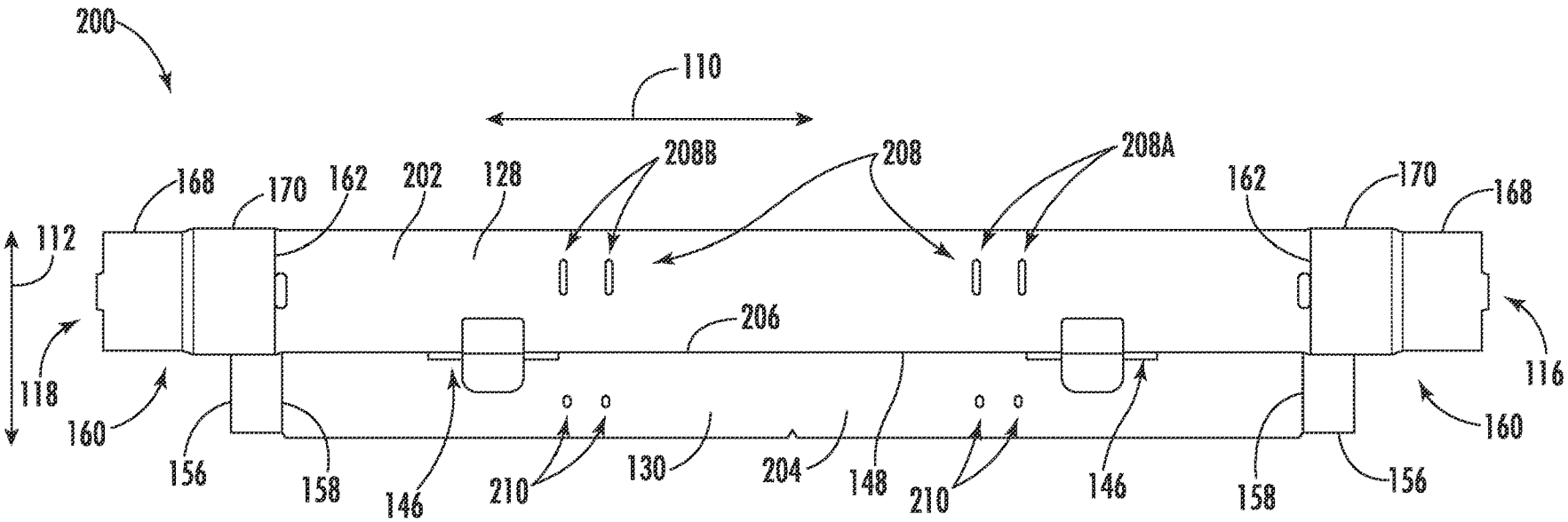
FIG. 8 illustrates a top view of another embodiment of an alignment tool for use in installing a covering relative to a frame of an architectural structure in accordance with aspects of the present subject matter.

Furthermore, the apertures 212 may identify the minimum mounting hole depth on the horizontally-extending surface 238 of the frame 214 for inside mounting of the covering 102. More specifically, when the second panel 204 is positioned adjacent to the horizontally-extending surface 238 of the frame 214, the apertures 212 may identify mounting hole locations for installing the covering 102 relative to the horizontally-extending surface 238 that are at a minimum installation depth. Such minimum depth may, in turn, be the minimum distance extending from the vertically-extending surface 236 of the frame 214 toward the architectural feature at which the mounting holes can be formed in the horizontally-extending surface 238 of the frame 214. When mounting holes are formed closer to the vertically-extending surface 236 than the minimum depth, there may be insufficient material associated with the horizontally-extending surface 238 for the fasteners received in such mounting holes to engage, thereby resulting in an insecure coupling of the covering 102 to the frame 214. In this respect, the apertures 212 may be defined at a transverse position on the second panel 204 that corresponds to the minimum mounting depth of the covering 102. As shown in FIG. 8, in an alternative embodiment, the first set of apertures 210 may be used to identify the mounting hole locations associated with flushing mounting the covering 102 and the mounting hole locations for installing the covering 102 at the minimum installation depth. Thus, in such embodiment, the second panel 202 may not define the apertures 212.

As shown in FIG. 7, like the apertures 208 defined by the first panel 202, the apertures 210, 212 defined by the second panel 204 may similarly be spaced apart from each other along the lateral direction 110 to identify mounting locations for a plurality of brackets (not shown) for coupling the covering 102 relative to the frame 214. For example, as shown, in one embodiment, each of the apertures 210, 212 may be aligned with one of the apertures 208 defined by the first panel 202. In such an embodiment, the apertures 210, 212 may identify similar mounting hole locations for a first bracket (not shown) used to couple a first side of the covering 102 to a first side of the frame 214 and a second bracket (not shown) used to couple an opposed, second side of the covering 102 to an opposed, second side of the frame 214. However, in alternative embodiments, the second panel 204 may define any other suitable number of apertures and/or the apertures may be positioned at any other suitable positions on the on the second panel 204.

Figure 9:
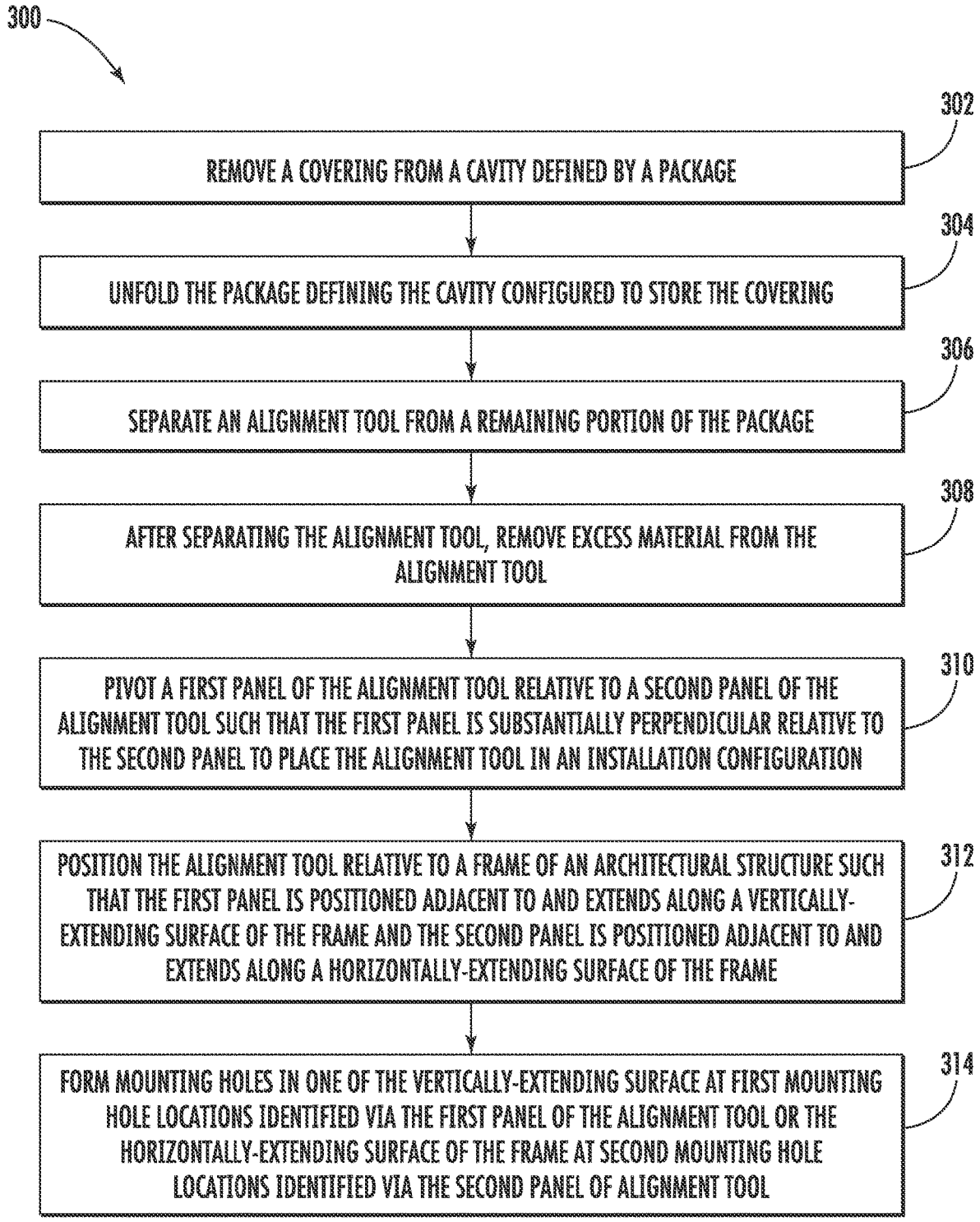
FIG. 9 illustrates a flow diagram of one embodiment of a method for installing a covering relative to a frame of an architectural structure in accordance with aspects of the present subject matter.

Referring now to FIG. 9, a flow diagram of one embodiment of a method 300 for installing a covering relative to a frame of an architectural structure is illustrated in accordance with aspects of the present subject matter. In general, the method 300 will be described herein with reference to the package 100 and the alignment tool 200 described above with reference to FIGS. 1-8. However, it should be appreciated by those of ordinary skill in the art that the disclosed method 300 may generally be implemented with any package having any suitable package configuration and/or with any alignment tool having any suitable tool configuration. In addition, although FIG. 9 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 9, at (302), the method 300 may include removing a covering from a cavity defined by a package. More specifically, as described above, a covering 102 may be stored within a cavity 103 defined by a package 100 to permit transportation of the covering 102. In this respect, the covering 102 may be removed from the cavity 103 defined by the package 100 prior to installation of the covering 102 relative to a frame 214 of an architectural structure, such as a window or door.

Additionally, at (304), the method 300 may include unfolding the package defining the cavity configured to store the covering. As described above, unfolding of the package 100 from which the covering 102 was removed may transition the package 100 from the folded configuration (e.g., as shown in FIGS. 1 and 2) to the unfolded configuration (e.g., as shown in FIG. 3). In this respect, after the covering 102 is removed from the package 100, the package 100 may be unfolded or otherwise collapsed/flattened such that the package 100 is in the unfolded configuration.

As shown in FIG. 9, at (306), the method 300 may include separating an alignment tool from a remaining portion of the package. As described above, one or more walls of the package 100 may define an alignment tool 200 for use in installing the covering 102 relative to a frame of an architectural structure, such as a window or door. Specifically, in several embodiments, one or more perforations may be defined between the portion of the package 100 forming the alignment tool 200 and the remaining portion(s) of the package 100. In such embodiments, the package 100 may be torn along such perforation(s) (e.g., by hand) to separate the alignment tool 200 from the remaining portion(s) of the package 100. However, in alternative embodiments, the alignment tool 200 may be separated from the remaining portion(s) of the package 100 in any other suitable manner, such as by cutting along the fold line(s) (e.g., a crease(s) positioned at such fold line(s)) or a printed cut line(s) separating the alignment tool 200 from the remaining portion(s) of the package 100. Moreover, in further embodiments, the alignment tool 200 may not be separated from the remaining portion(s) of the package 100. In such embodiments, the alignment tool 200 may be used to identify the mounting hole locations for the covering 102 while still part of the entire package 100.

Furthermore, after separating the alignment tool, at (308), the method 300 may include removing excess material from the alignment tool. As described above, in several embodiments, the covering 102 may have been cut to a specific lateral length while in the package 100. In such embodiments, the first and second transversely-extending walls may have been removed from the package 100 during cutting and replaced with end caps (not), which are typically removed at (302). However, in certain embodiments, when the covering 102 was not cut to length while in the package 100, portions of the first and second transversely-extending walls 134, 136 may remain attached to the separated alignment tool. In many instances, such as when outside mounting the covering 102 relative to a vertically-extending surface 236 of the frame 214, such excess material attached to the alignment tool 200 may not interfere with its operation. However, in certain instances, such as when inside mounting the covering 102 relative to a horizontally-extending surface 238 of the frame 214, it may be necessary to remove the excess material. In such instances, the portions of the first and second transversely-extending walls 134, 136 attached to the separated alignment tool 200 may be cut or torn off.

As shown in FIG. 9 at (310), the method 300 may include pivoting a first panel of the alignment tool relative to a second panel of the alignment tool such that the first panel is substantially perpendicular relative to the second panel to place the alignment tool in an installation configuration. More specifically, in several embodiments, the first panel 202 of the alignment tool 200 may be pivoted relative to the second panel 204 of the alignment tool 200 such that the first panel 202 is substantially perpendicular to the second panel 204 to place the alignment tool 200 in the installation configuration (e.g., as shown in FIG. 9). As will be described below, once the alignment tool 200 is in the installation configuration, the alignment tool 200 may be used to identify various mounting hole locations on a frame of an architectural structure relative to which the covering 102.

Figure 10:
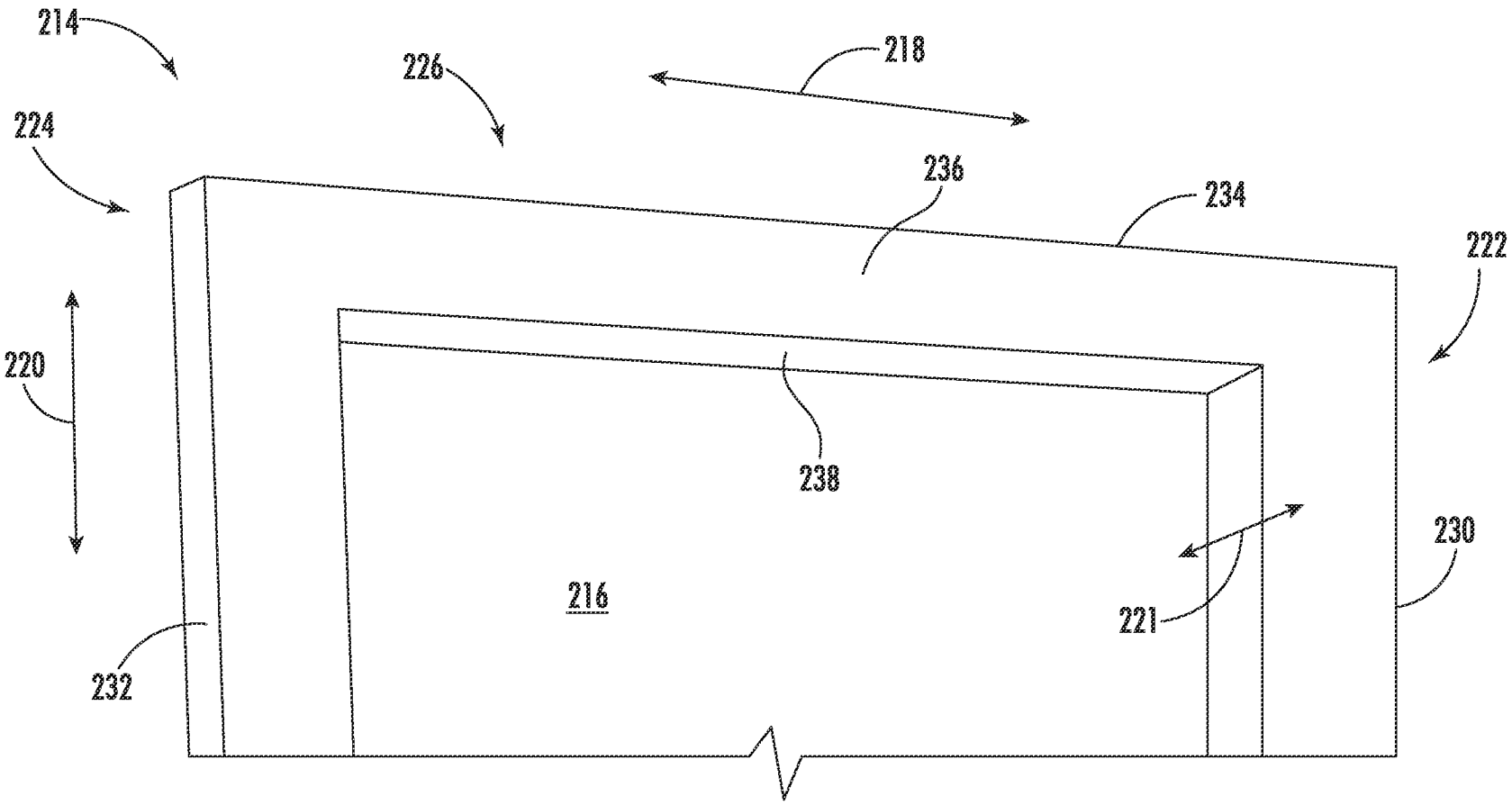
FIG. 10 illustrates a perspective view of an embodiment of a frame of an architectural structure relative to which a covering may be installed in accordance with aspects of the present subject matter.

Referring now to FIG. 10, an embodiment of a frame 214 for an architectural structure 216 relative to which a covering may be installed is illustrated in accordance with aspects of the present subject matter. In the illustrated embodiment, the architectural structure 216 is configured as a window. However, in alternative embodiments, the architectural structure 216 may be configured as any suitable type of architectural structure relative to which a covering may be installed, such as a door.

As shown in FIG. 10, the frame 214 defines a lateral direction 218, a vertical direction 220, and a transverse direction 221. More specifically, the lateral direction 218 may extend between a first lateral side 222 of the frame 214 and a second lateral side 224 of the frame 214. Furthermore, the vertical direction 220 may extend perpendicular to the lateral direction 218 and between a top end 226 of the frame 214 and a bottom end (not shown) of the frame 214. Additionally, the transverse direction 221 may extend perpendicular to the lateral and vertical directions 218, 220 and between a portion of the architectural structure 216 (e.g., the window pane) and a surface of the frame 214 distal to the structure 216.

In several embodiments, the frame 214 may include a plurality of frame members. Specifically, in one embodiment, the frame 214 may include first and second side frame members 230, 232 that extend in the vertical direction 220 between the top and bottom ends 226 of the frame 214. The first and second vertically-extending members 230, 232 may, in turn, be spaced apart in the lateral direction 218. In addition, the frame 214 may include a top frame member 234 positioned proximate to the top end 226 of the frame 214. The top frame member 234 may, in turn, extend in the lateral direction 218 between the first and second side frame members 230, 232. Additionally, the frame 214 may include a bottom frame member (not shown) positioned proximate to the bottom end of the frame 214, with the bottom frame wall extending in the lateral direction 218 between the first and second side frame members 230, 232.

Additionally, in several embodiments, the top frame member 234 may include a vertically-extending surface 236 and a horizontally-extending surface 238. The vertically-extending surface 236 may generally extend in the lateral direction 218 between the first and second lateral sides 224, 226 of the frame 214 and in the vertical direction 220 between the top end 226 of the frame 214 and the horizontally-extending surface 238. As such, the vertically-extending surface 236 may face outwardly towards the room. Furthermore, the horizontally-extending surface 238 may be positioned below and extend substantially perpendicular to the vertically-extending surface 236. As such, the horizontally-extending surface 238 may extend in the transverse direction 221 from the vertically-extending surface 236 to the architectural structure 216 (e.g., the window pane). In this respect, the horizontally-extending surface 238 may faces towards the bottom of the frame 214. As will be described below, the covering 102 may be coupled (e.g., via brackets) to one of the vertically-extending or horizontally-extending surfaces 236, 238 of the top frame member 234.

Figure 11:
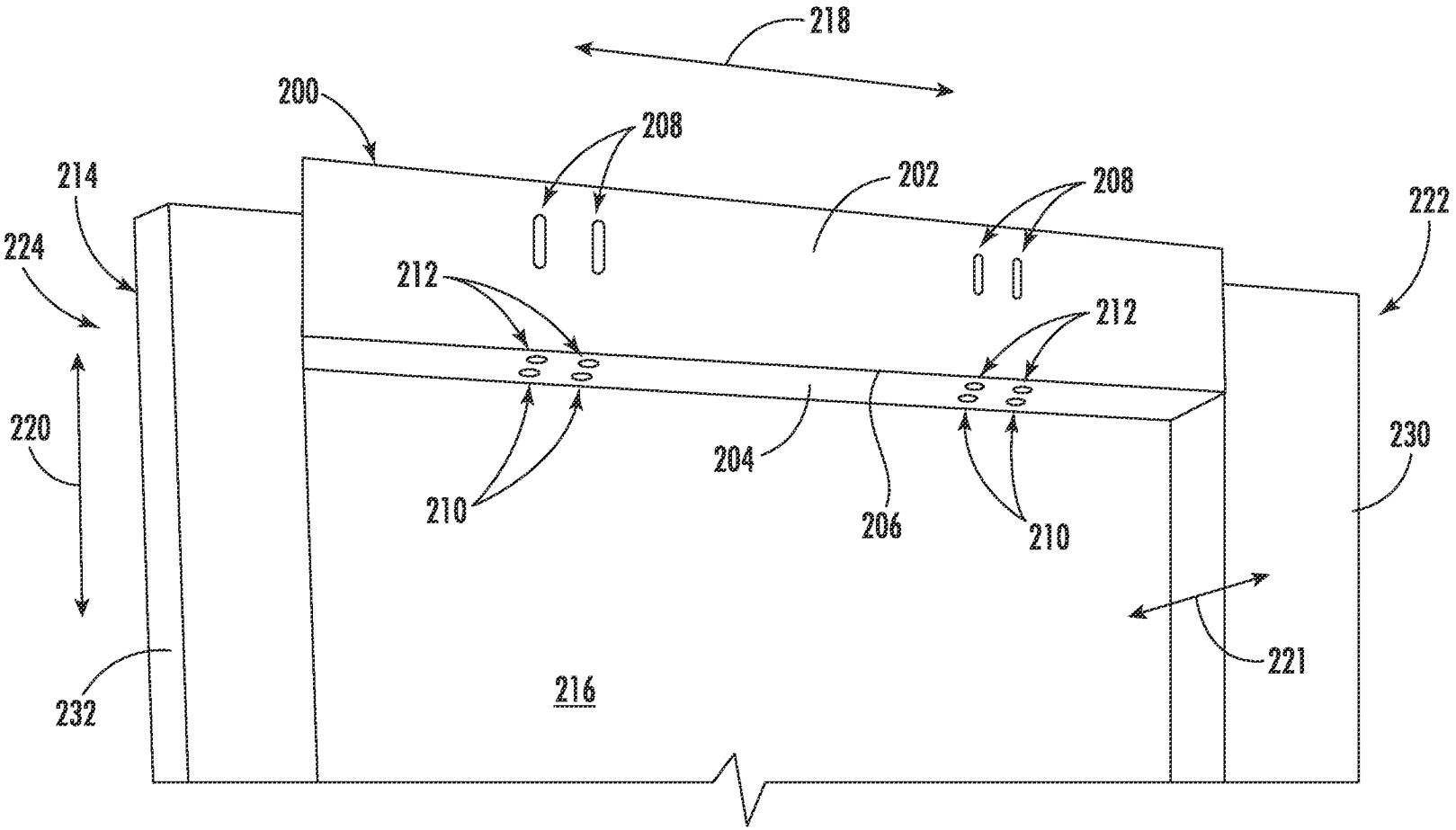
FIG. 11 illustrates another perspective view of the frame shown in FIG. 10, particularly illustrating one embodiment of an alignment tool positioned adjacent to the frame.
Figure 12:
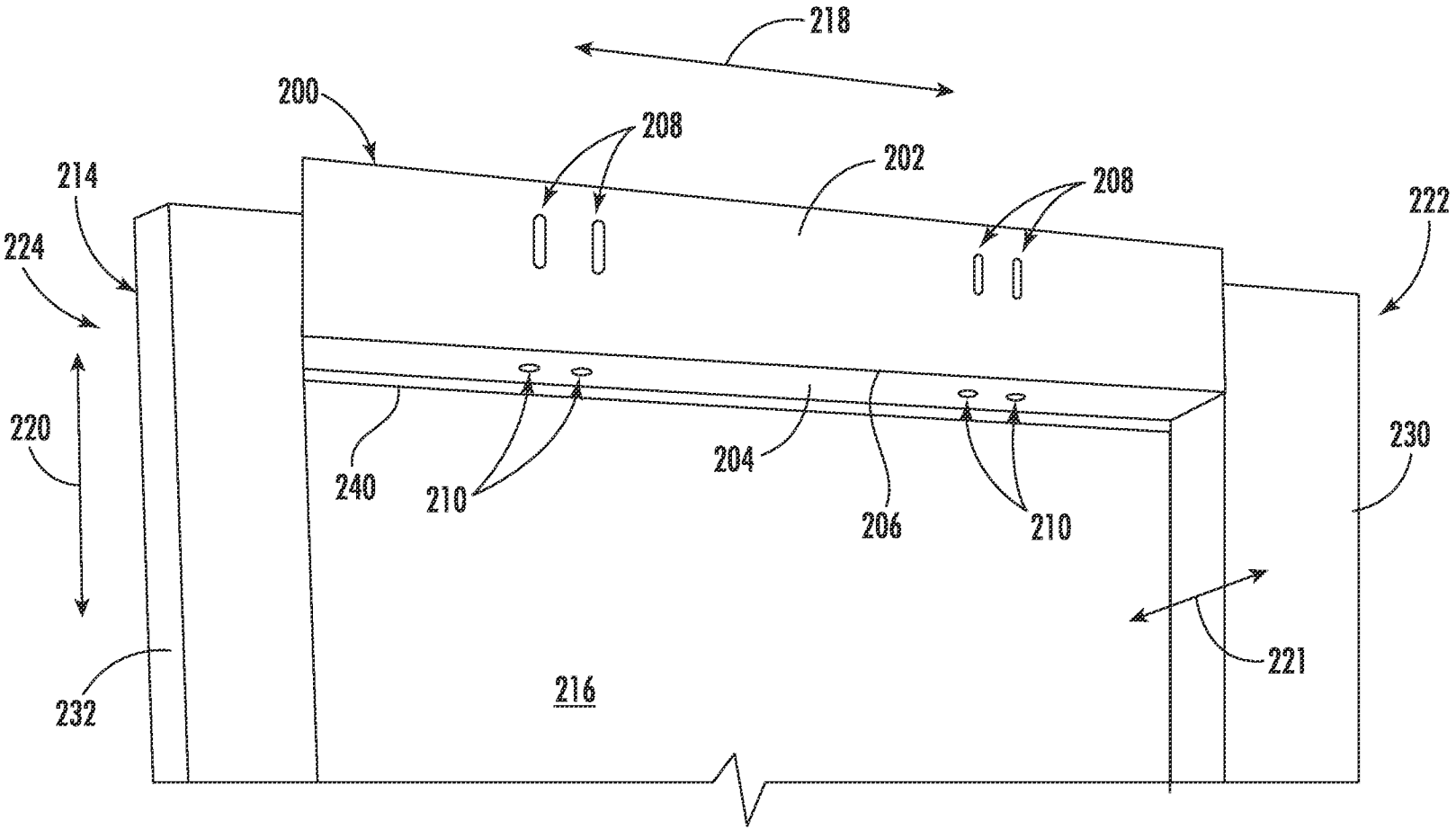
FIG. 12 illustrates another perspective view of the frame shown in FIG. 10, particularly illustrating another embodiment of an alignment tool positioned adjacent to the frame for flush-mounting of the covering.
Figure 13:
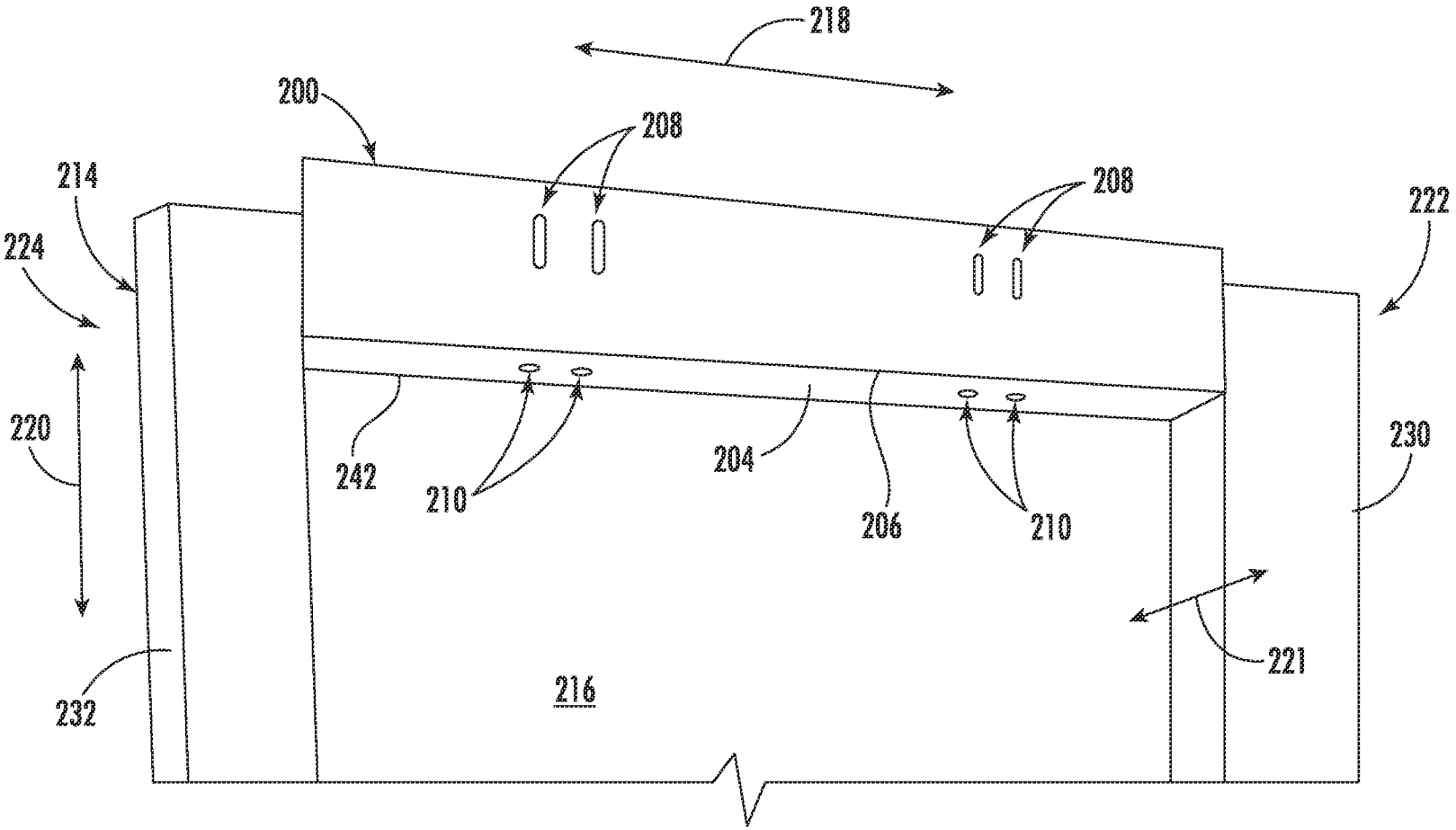
FIG. 13 illustrates a further perspective view of the frame shown in FIG. 10, particularly illustrating the alignment tool shown in FIG. 12 positioned adjacent to the frame for installing the covering at a minimum installation depth.

Referring back to FIG. 9, at (312), the method 300 may also include positioning the alignment tool relative to the frame such that the first panel is positioned adjacent to and extends along a vertically-extending surface of the frame and the second panel is positioned adjacent to and extends along a horizontally-extending surface of the frame. For example, in several embodiments, the alignment tool 200 may be positioned relative to the frame 214 of the architectural structure 216. Specifically, as shown in FIGS. 11-13, the first panel 202 of the alignment tool 200 is positioned adjacent to and extends along the vertically-extending surface 236 of the frame 214. In one embodiment, the lateral ends 116, 118 of the alignment tool 200 may be positioned flush against the corresponding side frame members 230, 232. As such, the apertures 206 defined by the first panel 202 may define mounting hole locations on the vertically-extending surface 236 for outside mounting the covering 102 relative to the frame 214. Furthermore, the second panel 204 of the alignment tool 200 may be positioned adjacent to and extend along the horizontally-extending surface 238 of the frame 214. As such, the apertures 210, 212 defined by the second panel 204 may define mounting hole locations on the horizontally-extending surface 238 for inside mounting the covering 102 relative to the frame 214.

Furthermore, as shown in FIG. 9, at (314), the method 300 may include forming mounting holes in one of the vertically-extending surface at the first mounting hole locations identified via the first panel of the alignment tool or the horizontally-extending surface of the frame at the second mounting hole locations identified via the second panel of the alignment tool. In several embodiments, mounting holes in the frame 214 may be formed (e.g., via drilling) based on the locations of the apertures 208, 210, 212 defined by the alignment tool 200. Specifically, when it is desired to outside mount the covering 102 relative to the frame 214, mounting holes may be formed in the vertically-extending surface 236 of the frame 214 based on the locations of the apertures 208 defined by the first panel 202.

However, when it is desired to inside mount the covering 102 relative to the frame 214, mounting holes in the horizontally-extending surface 238 of the frame 214 may be formed based on the locations of the apertures defined by the second panel 202. As mentioned above, in several embodiments, the second panel 202 may define the first set of apertures 210 and the second set of apertures 212. As shown in FIG. 11, in such embodiments, the apertures 210 may be used when it is desired to flush mount the covering 102 (such that the surface of the headrail 104 of the covering 102 distal to the architectural structure 216 is flush or coplanar with the vertically-extending surface 236). Conversely, the apertures 212 may be used when it is desired to mount the covering 102 at its minimum depth relative to the vertically-extending surface 236 (i.e., at the minimum distance from the vertically-extending wall 234 in the transverse direction 221).

Alternatively, as mentioned above, in one embodiment, the second panel 204 may define only the apertures 210. As such, the apertures 210 may be used for both flushing the covering 102 and mounting the covering 102 at its minimum mounting depth. Specifically, as shown in FIG. 12, when it is desired to flush mount the covering 102, the alignment tool 200 may be positioned relative to the frame 214 such that the first panel 202 is flush against the vertically-extending surface 236 of the frame 214. Such placement of the first panel 202 may position the second panel 204 relative to the horizontally-extending surface 238 such that the apertures 210 identify mounting holes locations associated with flush-mounting the covering 102. Furthermore, in such embodiments, the length of the second panel 202 in the transverse direction 221 may be longer the length of the horizontally-extending surface 238 in the transverse direction 221. As such, when the first panel 202 is flush against the vertically-extending surface 236, a portion 240 of the second panel 202 may be folded down along the surface of the architectural structure 216.

Furthermore, as shown in FIG. 13, when it is desired to mount the covering 102 at its minimum depth relative to the vertically-extending surface 236, the alignment tool 200 may be positioned relative to the frame 214 such that an edge 242 of the second panel 204 is flush against the surface of the architectural structure 216. Such placement of the second panel 204 may position the second panel 204 relative to the horizontally-extending surface 238 such that the apertures 210 identify mounting holes locations associated with minimum mounting depth of the covering 102. Additionally, when the alignment tool 200 is positioned in this manner, the first panel 202 may be spaced apart from the vertically-extending surface 236 in the transverse direction 221 such that a gap (not shown) is defined between the first panel 202 and the vertically-extending surface 236.

While the foregoing Detailed Description and drawings represent various embodiments, it will be understood that various additions, modifications, and substitutions may be made therein without departing from the spirit and scope of the present disclosure. Each example is provided by way of explanation without intent to limit the broad concepts of the present disclosure. In particular, it will be clear to those skilled in the art that principles of the present disclosure may be embodied in other forms, structures, arrangements, proportions, and with other elements, materials, and components, without departing from the spirit or essential characteristics thereof. For instance, features illustrated or described as part of one embodiment can be used with another embodiment to yield a still further embodiment. Thus, it is intended that the present disclosure covers such modifications and variations as come within the scope of the appended claims and their equivalents. One skilled in the art will appreciate that the disclosure may be used with many modifications of structure, arrangement, proportions, materials, and components and otherwise, used in the practice of the disclosure, which are particularly adapted to specific environments and operative requirements without departing from the principles of the present disclosure. For example, elements shown as integrally formed may be constructed of multiple parts or elements shown as multiple parts may be integrally formed, the operation of elements may be reversed or otherwise varied, the size or dimensions of the elements may be varied. The presently disclosed embodiments are therefore to be considered in all respects as illustrative and not restrictive, the scope of the present disclosure being indicated by the appended claims, and not limited to the foregoing description.

It should also be understood that, as described herein, an "embodiment" (such as illustrated in the accompanying Figures) may refer to an illustrative representation of an environment or article or component in which a disclosed concept or feature may be provided or embodied, or to the representation of a manner in which just the concept or feature may be provided or embodied. However, such illustrated embodiments are to be understood as examples (unless otherwise stated), and other manners of embodying the described concepts or features, such as may be understood by one of ordinary skill in the art upon learning the concepts or features from the present disclosure, are within the scope of the disclosure. In addition, it will be appreciated that while the Figures may show one or more embodiments of concepts or features together in a single embodiment of an environment, article, or component incorporating such concepts or features, such concepts or features are to be understood (unless otherwise specified) as independent of and separate from one another and are shown together for the sake of convenience and without intent to limit to being present or used together. Independent concepts can be used in any configuration as may be appreciated by one ordinary skill in the art. For instance, concepts or features illustrated or described as part of one embodiment can be used separately, or with another embodiment to yield a still further embodiment. Thus, it is intended that the present disclosure covers such modifications and variations as come within the scope of the appended claims and their equivalents.

In the foregoing Detailed Description, it will be appreciated that the phrases "at least one", "one or more", and "and/or", as used herein, are open-ended expressions that are both conjunctive and disjunctive in operation. The term "a" or "an" element, as used herein, refers to one or more of that element. As such, the terms "a" (or "an"), "one or more" and "at least one" can be used interchangeably herein. All directional references (e.g., proximal, distal, upper, lower, upward, downward, left, right, lateral, longitudinal, front, rear, top, bottom, above, below, vertical, horizontal, crosswise, radial, axial, clockwise, counterclockwise, and/or the like) are only used for identification purposes to aid the reader's understanding of the present disclosure, and/or serve to distinguish regions of the associated elements from one another, and do not limit the associated element, particularly as to the position, orientation, or use of the present disclosure. Connection references (e.g., attached, coupled, connected, joined, secured, mounted and/or the like) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another.

All apparatuses and methods disclosed herein are examples of apparatuses and/or methods implemented in accordance with one or more principles of the present disclosure. These examples are not the only way to implement these principles but are merely examples. Thus, references to elements or structures or features in the drawings must be appreciated as references to examples of embodiments of the present disclosure, and should not be understood as limiting the disclosure to the specific elements, structures, or features illustrated. Other examples of manners of implementing the disclosed principles will occur to a person of ordinary skill in the art upon reading this disclosure.

This written description uses examples to disclose the present disclosure, including the best mode, and also to enable any person skilled in the art to practice the present disclosure, including making and using any devices or systems and performing any incorporated methods. The patentable scope of the present disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

The following claims are hereby incorporated into this Detailed Description by this reference, with each claim standing on its own as a separate embodiment of the present disclosure. In the claims, the term "comprises/comprising" does not exclude the presence of other elements or steps. Furthermore, although individually listed, a plurality of means, elements or method steps may be implemented by, e.g., a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second", etc., do not preclude a plurality. Reference signs in the claims are provided merely as a clarifying example and shall not be construed as limiting the scope of the claims in any way.

The invention claimed is:

1. A packaged covering, comprising:

a covering for an architectural structure, the covering comprising a headrail, a bottom rail, and at least one covering element extending between the headrail and the bottom rail;

a package comprising a plurality of walls at least partially defining a cavity configured to receive the covering, the plurality of walls including a bottom wall and first and second laterally-extending walls oriented perpendicular relative to and joined to the bottom wall, wherein first and second panels of an alignment tool are formed by at least one wall of the plurality of walls, the first panel defining a plurality of apertures identifying first mounting hole locations for installing the covering on a vertically-extending surface of a frame of the architectural structure, the second panel defining a plurality of apertures identifying second mounting hole locations for installing the covering on a horizontally-extending surface of the frame.

2. The packaged covering of claim 1, wherein the second mounting hole locations correspond to mounting locations for mounting one or more brackets of the covering to the frame of the architectural structure to provide for an inside mounting of the covering.

3. The packaged covering of claim 1, wherein the first and second mounting hole locations correspond to mounting locations to provide for an outside mounting or an inside mounting, respectively, of the covering relative to the frame of the architectural structure.

4. The packaged covering of claim 1, wherein the plurality of apertures identify a first set of second mounting hole locations and a second set of second mounting hole locations, the first set of second mounting hole locations being associated with flush-mounting the covering on the horizontally-extending surface of the frame, the second set of second mounting hole locations being associated with installing the covering at a minimum installation depth on the horizontally-extending surface of the frame.

5. The packaged covering of claim 1, wherein the first mounting hole locations correspond to mounting locations for mounting one or more brackets of the covering to the frame of the architectural structure to provide for an outside mounting of the covering.

6. The packaged covering of claim 1, wherein the first panel is joined directly to the second panel via a fold line provided at an interface between the first and second panels.

7. The packaged covering of claim 1, wherein the first panel is defined by a first wall of the plurality of walls and the second panel is defined by a second wall of the plurality of walls.

8. The packaged covering of claim 1, wherein the first and second panels are defined by a common wall of the plurality of walls.

9. The packaged covering of claim 1, wherein the first and second panels are defined by the bottom wall.

10. The packaged covering of claim 1, wherein the plurality of walls further includes a lid joined to one of the first laterally-extending wall or the second laterally-extending wall, the lid including a first lid portion defining the first panel and a second lid portion defining the second panel.

11. The packaged covering of claim 1, wherein the first panel is configured for placement adjacent to the vertically-extending surface of the frame and the second panel is configured for placement adjacent to the horizontally-extending surface of the frame.

12. The packaged covering of claim 1, wherein the first panel is joined to the second panel at a fold line such that the first panel and the second panel are pivotable between an unfolded configuration in which the first panel and the second panel are substantially coplanar and an installation configuration in which the first panel and the second panel are substantially perpendicular.

* * * * *